US006053809A

United States Patent [19]

Arceneaux

[11] Patent Number: 6,053,809

[45] Date of Patent: Apr. 25, 2000

[54] SMOKE DETECTION AND VENTILATION SYSTEM

[76] Inventor: Henry M. Arceneaux, P.O. Box 1526, Lebanon, Tenn. 37007

[21] Appl. No.: 08/816,855

[22] Filed: Mar. 13, 1997

[51] Int. Cl.[7] ..... F24F 7/10

[52] U.S. Cl. ..... 454/228; 454/236; 454/342

[58] Field of Search ..... 454/228, 229, 454/236, 342, 357

[56] References Cited

U.S. PATENT DOCUMENTS

| | | | |
|---|---|---|---|
| 3,923,096 | 12/1975 | Van Der Lely | 454/185 X |
| 4,176,587 | 12/1979 | Cox | 454/342 X |
| 4,765,231 | 8/1988 | Aniello | 454/342 X |
| 4,805,835 | 2/1989 | Schaus | 454/342 X |
| 4,867,376 | 9/1989 | Arceneaux et al. . | |

*Primary Examiner*—Harold Joyce

*Attorney, Agent, or Firm*—C. Emmett Pugh; Pugh Associates

[57] ABSTRACT

A system for detecting the presence of smoke within a building and providing means to remove the smoke, into the airspace above the ceiling thereby preventing or at least alleviating smoke inhalation, property damage, and allowing more time for the safe evacuation from the premises. The system is comprised of a conventional smoke detector which activates control means for raising and lowering a generally planar panel which is installed in a ceiling. Smoke is removed from the airspace below the ceiling to the airspace above the ceiling. An optional fan, remote fan relay, exhaust vent and back draft damper further aid in the exhausting of the smoke from the building. A fusible link in the control means protects the ceiling fire rating.

18 Claims, 4 Drawing Sheets

FIG. 1A
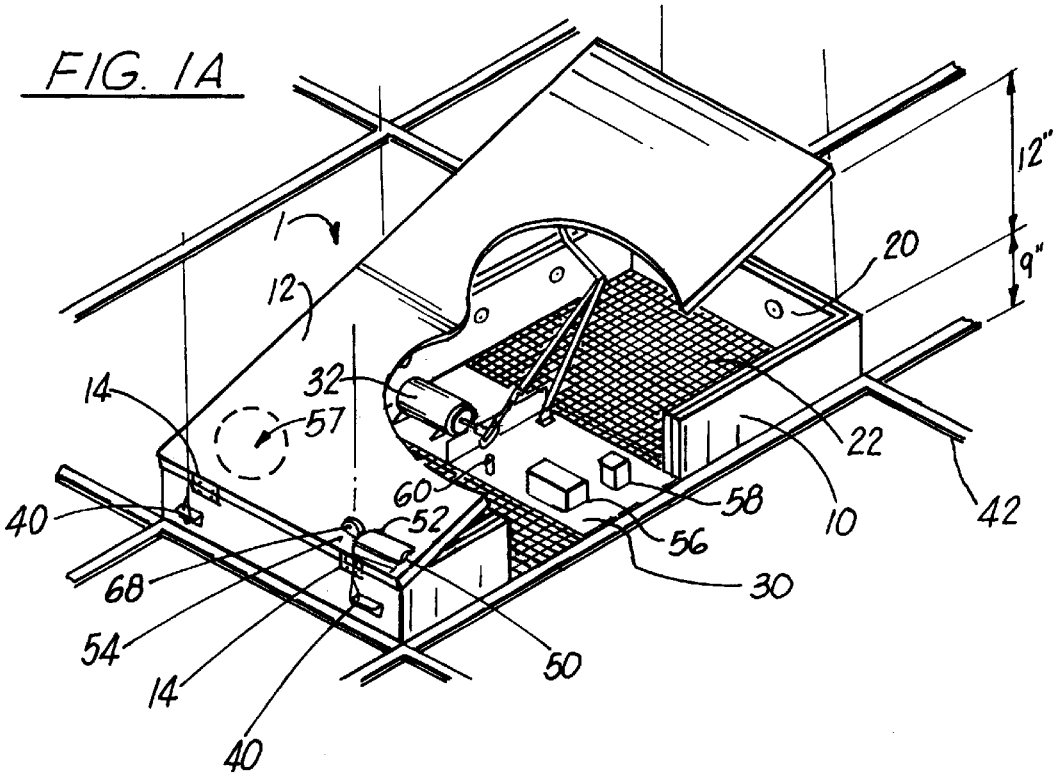
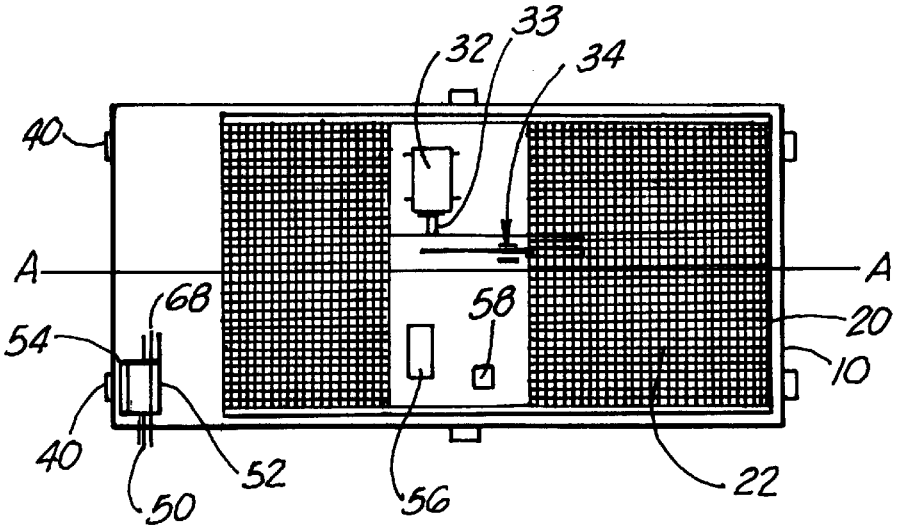
FIG. 1B

SMOKE DETECTION AND VENTILATION SYSTEM

REFERENCE TO RELATED PATENT

The disclosure of U.S. Pat. No. 4,867,376, issued on Sep. 19, 1989, to Arceneaux, et al. is hereby incorporated by reference.

TECHNICAL FIELD

The present invention relates to smoke detection and ventilation systems and more particularly to a system for ventilating smoke to the air space above the ceiling so as to prevent smoke inhalation and property damage due to smoke, provide additional evacuation time, and alert occupants of a building to the presence of smoke. The present invention also relates to a system for closing off communication with the air space above the ceiling when that space is used as an air conditioning return plenum when smoke is detected.

BACKGROUND ART

Various attempts have been made at providing safety mechanisms in buildings which alert the occupants thereof to fire through the detection of smoke. However, the fact that people have become alerted to the presence of smoke does not necessarily enable their evacuation or prevent property damage due to smoke. The majority of fire related deaths, approximately eighty (80%) percent are due to smoke inhalation and not the fire directly.

The mere presence of smoke, regardless of the inhabitants awareness of it, is dangerous. Smoke causes property damage, it is difficult to see through and obviously creates breathing problems making evacuation from a smoke filled environment difficult.

In the event that additional time is needed to evacuate small children, handicapped persons, or elderly persons from a burning building, the occupants of the building and/or rescuers are placed in jeopardy of smoke inhalation. Further, the decreased visibility due to the smoke further hampers evacuation and extermination of the fire.

Thus, simply alerting occupants to the existence of smoke is not enough to eradicate all of the problems caused by smoke in a building.

Further there are instances where the removal of smoke from a building is preferably accomplished without alarming the occupants thereof. In the case of restaurants, bars, lounges, dance halls and such places where there is likely to be an accumulation of smoke due to cigarettes, cigars, or pipes, there is no need for an alarm, yet the removal of the smoke once it has reached a predetermined level, is desirable. As of now, there is no method of detecting smoke in an alarmless fashion and providing for its removal.

GENERAL SUMMARY DISCUSSION OF INVENTION

The present invention provides a device and system which may be used to detect the presence of smoke, alert occupants to the presence of smoke if desired, and remove the smoke from the building through the air space above the ceiling, the attic, or through an exhaust duct. The device may be used in connection with other standard environmental controls such as a humidistat, thermostat or alarm system.

The device of the present invention comprises an air control unit which may be installed in a drop ceiling in place of a standard ceiling tile and may be installed in a ceiling where the air space above the ceiling is used as a return air plenum. The air control unit, which fits within the ceiling, includes a pivotal panel and a panel control member which raises or lowers the pivotal panel in response to smoke conditions detected. In the event that the device is used in combination with other controls, the panel may raise or lower at the direction of those controls as well.

When smoke is detected, the panel is raised or lowered as appropriate, allowing smoke to flow into the air space above the ceiling. From there it may be exhausted out of the building by a traditional exhaust duct and/or exhaust fan which can be electrically connected to the device of the present invention so as to turn on when smoke is detected.

It is thus an object of the present invention to provide a system for removing smoke from an occupied area within a building to an unoccupied area such as the air space above the ceiling, the attic, or an exhaust system, in order to prevent property damage, smoke inhalation, and the general irritation caused by a smoke filled environment.

It is a further object of the system of the present invention to provide a smoke ventilation device that is adaptable for use with existing alarm and environmental control systems within a building, installed in ceiling and utilizing the air space above the ceiling.

It is a still further object of the system of the present invention to provide an alarmless system for removing smoke from an occupied area within a building to an unoccupied area so as to alleviate the irritations of cumulated smoke particularly in social environments.

Other advantages, achievements and objects of the present invention will become apparent in considering the preferred embodiments described below.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 1A is a perspective view of the preferred embodiment of the system of the invention.

FIG. 1B is a plan view of the embodiment of FIG. 1A with the upper panel 12 removed.

EXEMPLARY MODE FOR CARRYING OUT THE INVENTION

Figure 2:
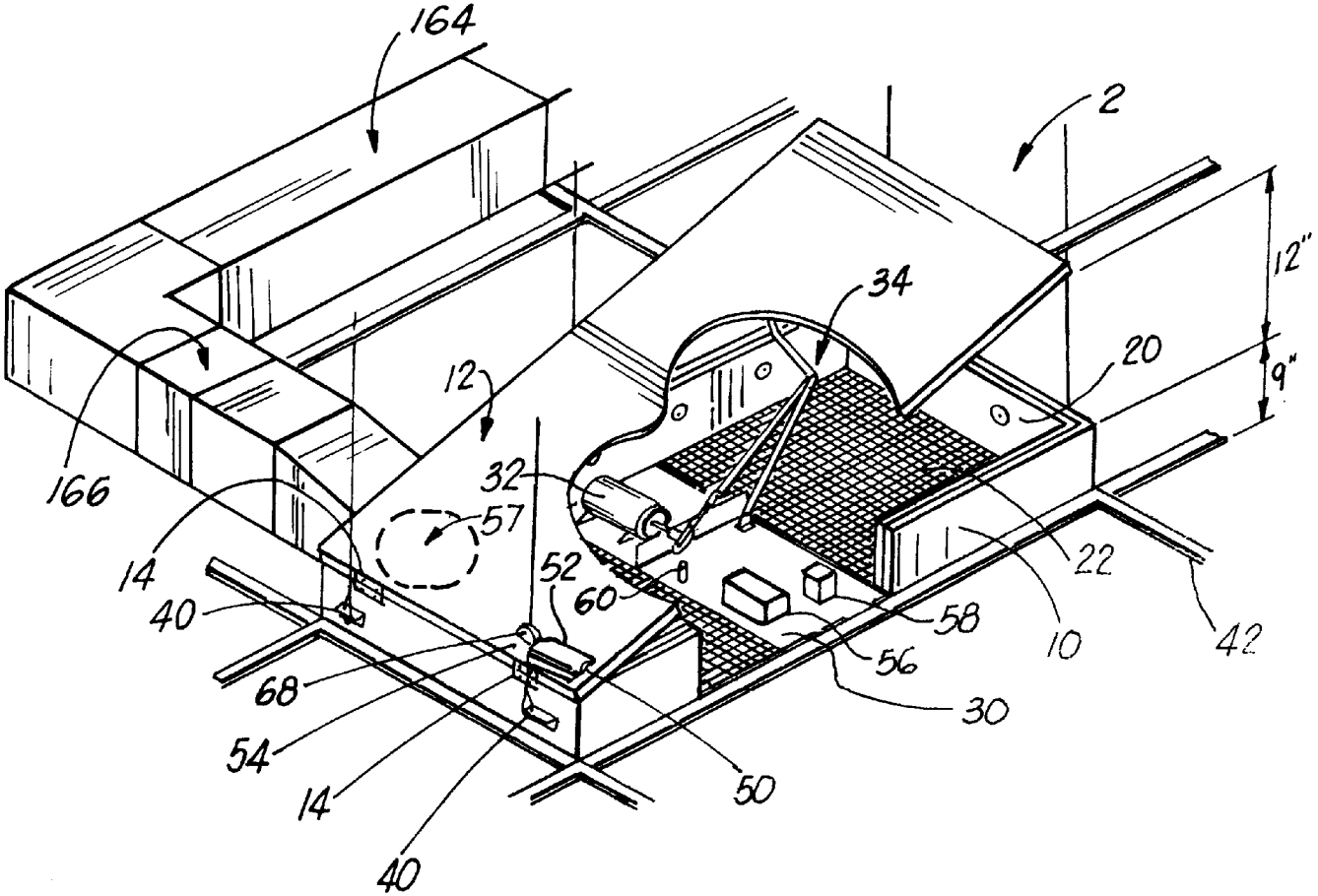
FIG. 2 is a perspective view of the preferred embodiment of the system of the invention adapted for use when the air space above the ceiling is used as a return air plenum.

As shown in FIGS. 1A & 1B, the preferred embodiment of the system of the present invention is comprised of a smoke ventilation device 1, further comprised of a smoke detector 57 with or without an audible alarm as desired, and thermostat 56, in controlled electrical connection with a raising arm assembly 34. The system is constructed of a body member 10 forming a box-like structure for simple installation in a ceiling grid 42 by hanging clips 40, which suspend the device 1 in the ceiling in place of a ceiling tile.

Figure 3A:
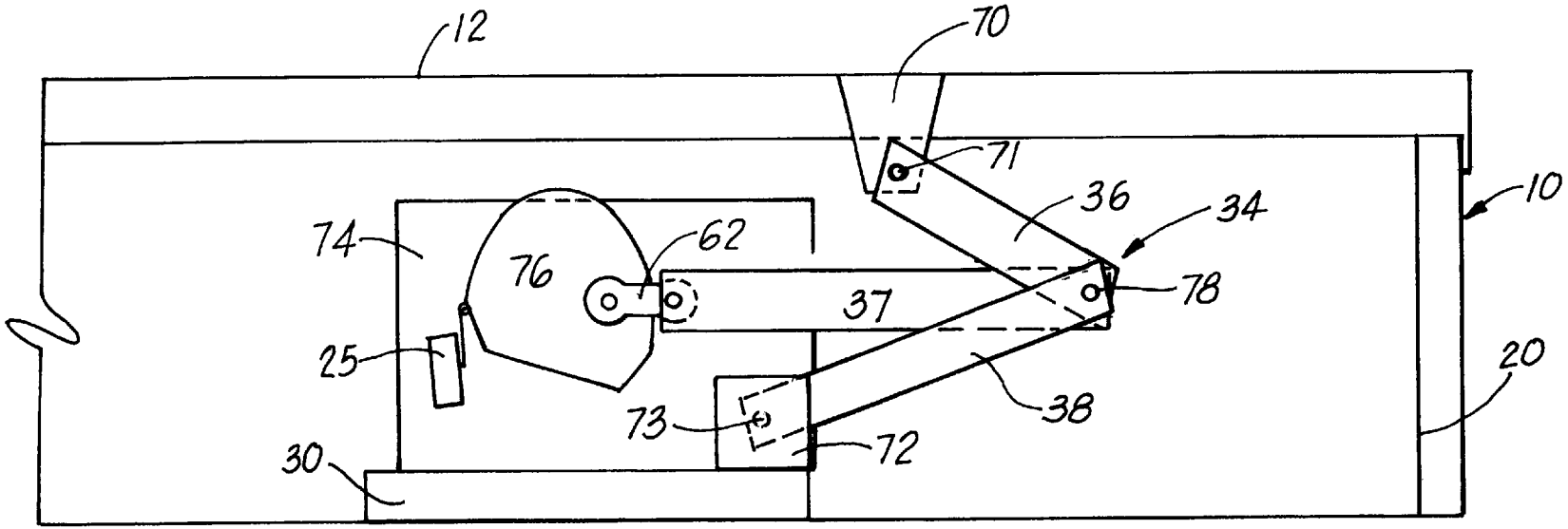
FIG. 3A is a partial, side cross-sectional view taken along line A—A of FIG. 1B further illustrating the raising arm assembly in the closed position.
Figure 3B:
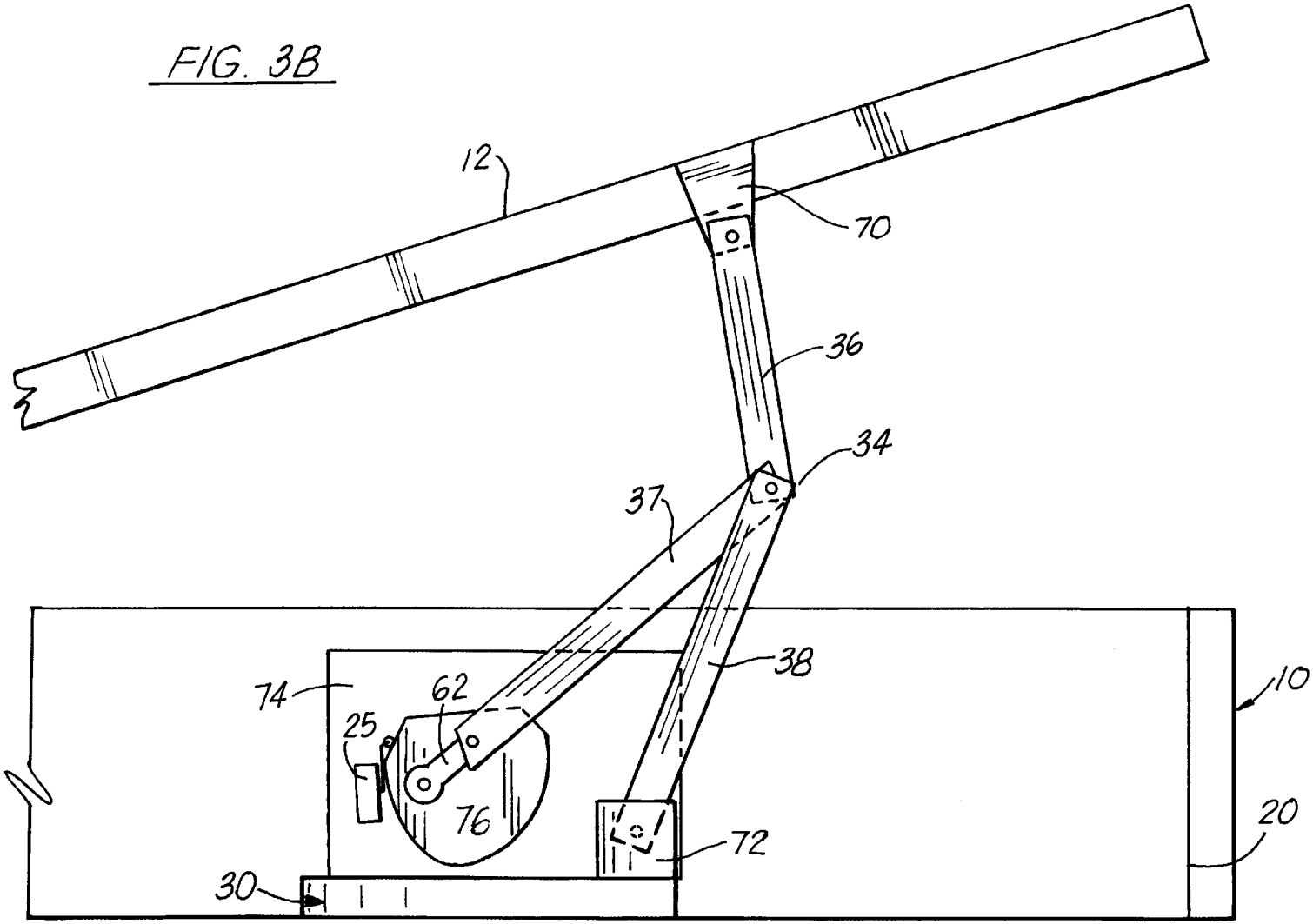
FIG. 3B is a partial, side cross-sectional view taken along line A—A of FIG. 1B further illustrating the raising arm assembly in the open position.

The device 1 sits on top of a grating 22 which may, for example, be made of polystyrene. On top of the grating 22 and forming the body or sides of the device is body member 10 which has an insulative lining 20. Fitting on top of the body member 10 is the upper quadrilateral planar panel 12 which is connected to the body member by hinges or other appropriate connectors 14. The panel 12 rotates between open and closed positions relative to the body member 10 via the raising arm assembly or control means 34 as shown in FIGS. 3A and 3B.

The upper planar panel 12 is made of, for example, twenty-two (22) gauge galvanized steel and is, for example, approximately forty seven and fifteen-sixteenths of an inch ($47\frac{15}{16}$") long with two perpendicular flaps at each end which are one and one-eight of an inch ($1\frac{1}{8}$th") long on the hinged end and one and one-half ($1\frac{1}{2}$") inch long on the other end. The panel 12 is also approximately twenty three and fifteen-sixteenths of an inch ($23\frac{15}{16}$th") wide with two perpendicular flaps at each side which are one and one-half of an inch ($1\frac{1}{2}$") long.

Electrical power wires enter the device at electrical entrance 50 and connect to the thermostat 56 and smoke detector 57 positioned on the underside of the panel 12, the motor 32, and optional humidistat (not shown) via humidistat wires 68, and relay 58. An operating light 60 indicates whether the device 1 is operational and is likewise electrically powered, and a power switch 52 near the electrical entrance 50 turns the device 1 on and off. The motor 32 operates the raising arm assembly 34 as more fully described below in connection with FIGS. 3A and 3B.

The motor 32, thermostat 56, relay 58 and raising arm assembly 34 are located on the grating 22 on top of a transverse support panel 30.

In operation, the upper quadrilateral planar panel 12, which is attached by conventional attachment means, for example hinges 14 to the body member 10, is maintained in a closed position over a grating 22 in the bottom of the body member 10. In this position there is no communication of air between the area below the ceiling and the area above the ceiling. Upon detection of smoke by the smoke detector 57, the control or raising arm assembly 34 raises the planar panel 12 to an open position allowing smoke to rise into the space above the ceiling and away from inhabitants of the building and property.

The raising arm assembly 34 is further comprised of support arm 36, pivot 38, and is powered by conventional motor 32, all of which are situated on a transversely arranged support panel 30. Additionally, the assembly 34 has a fusible link 62 connecting it to the motor 32. This fusible link 62 will melt at one hundred and sixty (160° F.) degrees Fahrenheit which will allow gravity to automatically close the panel 12. This feature preserves the ceiling fire rating, eliminates any "chimney effect" in a fire, and is preferably included in every embodiment of the device.

The body member 10 has insulation 20, which may be, for example, a one (1") inch thick ceramic refractory fiber blanket. Therefore, in the closed position, the device of the present invention has a three (3) hour Underwriters Laboratories Fire Rating Classification, which meets or exceeds almost all Ceiling Fire Ratings.

This embodiment of the device is particularly suitable for commercial use. It can be installed in a drop ceiling as shown in FIGS. 1A & 1B. The device may also be adapted for use when the air space above the ceiling is used as a return air plenum as shown in FIG. 2. Generally this occurs when the ceiling is a conventional drop ceiling as depicted in FIG. 2 but could also be adapted to other ceilings as would be readily obvious to one skilled in the art.

As shown in FIG. 2, the upper panel 12 remains in the open position until smoke is detected by the smoke detector. This allows the smoke ventilation device to function as an air register when there is no smoke present. Upon detection of smoke, the panel closes and smoke is pulled by a fan (not shown but generally known in the art) not into the space above the ceiling but into a conventional exhaust duct 164 (which may be, for example, 6"×6" or 6" round) and backdraft damper 166. At this point the device that detected the smoke ceases to be a part of the return air system and becomes a hood or smoke collector for the exhaust system. This prevents smoke from mixing with the return air, and removes it from the building, thereby eliminating the need to shut down the central air-conditioning and heating system. The devices that did not detect smoke continue to serve as return air registers in their open position.

This embodiment is generally controlled only by a smoke detector but may be interfaced with another or existing alarm system, in which case the smoke detector would not need to be used.

FIGS. 3A and 3B further illustrate the raising arm assembly in its closed and open positions, respectively. Raising arm assembly 34 is comprised of three arm components, a first operating arm 36, a second operating arm 38, and a support arms 37. All three arm are connected at one of each of their respective ends at arm pin 78.

The first operating arm is likewise connected to top panel 12 through a upper bracket 70, which is attached to arm 36 also through the use of a pin 71. The second operating arm 38 is connected to the support panel 30 through a lower bracket 72 which is attached to arm 38 through the use of a pin 73. Support arm 37 is attached to driving cam 76 through the use of a fusible link 62, which will fail at a predetermined temperature, allowing the panel 12 to close, preserving the fire rating of the ceiling.

Upper bracket 70 is positioned on the panel 12 approximately twelve and one-fourth of an inch ($12\frac{1}{4}$th") from one end of the panel.

The driving cam 76 is driven via the motor 32 powering the driving shaft 33 which extends through a motor bracket 74 and is connected to the cam 76. Upon the counterclockwise rotation of the cam 76, support arm 37 rotates upwards extending first and second operating arms 36 and 38, respectively, as shown in FIG. 3B, thereby raising the upper panel 12. Limit switch 25 placed adjacent the cam 76 activates and deactivates the motor 32 depending on its position relative to the cam 76. The limit switch may be of the brand called "MICRO"™ switch, commonly known and used by those of average skill in the art.

Support arm 37, first operating arm 36 and second operating arm 38 may all be made of, for example, a one inch by one eight (1"×$\frac{1}{8}$") inch aluminum flat bar. Support arm 37 is preferably approximately nine and seven-sixteenths of an inch ($9\frac{7}{16}$ths") long, first operating arm 36 is preferably, approximately five and nine-sixteenths of an inch ($5\frac{9}{16}$ths") long, and second operating arm 38 is preferably, approximately seven and thirteen-sixteenths of an inch ($7\frac{13}{16}$ths") long. Holes are placed in each end of all three arms with an approximate diameter of one-quarter of an inch ($\frac{1}{4}$") and spaced a distance of one-quarter of an inch ($\frac{1}{4}$") from each end.

The motor 32 is powered via a battery (not shown but generally known and further described below). Electrical entrance 50 has power and test switches 52. Additionally there is a thermostat bulb 54, an optional remote fan relay 58 which turns on an exhaust fan (not shown and known in the art) to aid in the removal of the smoke, and an operating light 60 indicating power.

The device may be used in connection with other standard environmental controls such as a humidistat, thermostat or alarm system. A remote fan relay may be included to turn on an existing exhaust fan when smoke is detected to aid in the removal of smoke from the system. A low voltage battery alarm may be included to signal a low voltage battery.

Additionally, multiple devices may be placed in any given zone of a building and electrically connected to a ventilation control panel which can operate multiple zones. If the zone on the panel is set to ventilate, the devices will remain in the open position, allowing ventilation of the air through them into the space above the ceiling. If the zone on the panel is set to automatic, the devices will operate as if no ventilation control panel were there, or upon the detection of smoke.

Also, if multiple devices are used, a remote closing relay may be provided that would close all devices not detecting smoke when one detects smoke so as to prevent the spread of the smoke.

The electrical power source for the device is typically a 12/24 volt DC 0.3 amp motor 32. The power source is preferably from a battery or an Underwriters Laboratories (UL) listed class 2 transformer with a DC converter or a UL listed auxiliary 12/24 VDC power source; maximum 12 or 24 volt secondary voltage; maximum 8 amp current after a one minute short. Using a battery, several units can be wired to one 12 or 24 volt battery, using four lines with five units per line. This battery should be a maximum of 8 amps, with an 8 amp 200%, 30–60 second delay fuse at its positive pole. It is preferably at eye level with an automatic cut-off charger to maintain it at full charge, without overcharging. It should preferably be a type two (2) suspended or gelled electrolyte, sealed and have a built-in one-way relief valve to release pressure buildup, then automatically reseal. This type of battery will melt instead of possibly exploding and thereby protect against injury to people in the event of a fire.

Other exemplary variations on the system of the present invention include using a different size fan or alternative damper to the butterfly damper.

It is noted that the embodiments described herein in detail for exemplary purposes is of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

What is claimed is:

1. A smoke control ventilation system for use in a building having a room with a ceiling containing air, with the ceiling dividing the room into an upper air space above the ceiling and a lower air space below the ceiling, said upper air space above the ceiling being used as a return air plenum and said lower air space being used as an environmental zone, said smoke ventilation system comprising:

a body member disposed in the ceiling generally allowing air from the environmental zone to flow through said body member, thereby providing air for flowing through to the return air plenum;

at least one panel located above said body member;

a mount mounting said panel on the body member within the ceiling, allowing said panel to be moved between a closed, sealing position, separating and isolating the upper and lower air spaces, preventing air in the lower air space from flowing through said body member and to the return air plenum, and an open position with the upper and lower air spaces in free communication with each other through said body member, allowing air to flow through said body member and to the return air plenum from the lower air space;

a motor associated with said body member and said panel for moving the panel to the open position and for moving the panel to the closed, sealing position with respect to said body member, said motor including support means for generally maintaining said panel in said open position after said motor caused the panel to be moved to the panel's open position, thereby continuously supplying air to the return air plenum;

smoke sensing means associated with said motor, lowering and closing the panel with respect to said body member when smoke is sensed; and exhaust means associated with said body member and located in said upper air space for segregating and removing smoke from the lower air space through the upper air space when said panel is closed and is isolating with said body member the upper air space from the lower air space, preventing the smoke from uncontrollably flowing into the upper air space.

2. The smoke ventilation system of claim 1, wherein:

said exhaust means comprises an exhaust duct.

3. The smoke ventilation system of claim 2, wherein:

said exhaust means further comprises a back draft damper associated with said exhaust duct.

4. The smoke ventilation system of claim 1, wherein the ceiling is a drop ceiling made of at least one ceiling tile, and wherein:

the smoke ventilation system is sized to replace the ceiling tile in the drop ceiling, and the lower air space is below the drop ceiling and the upper air space is above the drop ceiling.

5. The smoke ventilation system of claim 1, wherein:

said motor is an electric motor, and wherein there is further included:

a cam, driven and rotated by the motor to raise and lower said panel with respect to said body member.

6. The smoke ventilation system of claim 1, wherein:

said mount is a pivot mount and includes support means having a first end relatively rigidly contacting said panel, said support means including a fusible fire link which fails when the temperature of the air surrounding said fusible fire link reaches a predetermined temperature, causing said support means to fail and said panel to pivot downwardly to said closed, sealing position.

7. The smoke ventilation system of claim 1, wherein said smoke sensing means is alarmless.

8. The smoke ventilation system of claim 1, wherein:

said smoke sensing means includes an audible alarm which is actuated when a predetermined amount of smoke is detected by said smoke sensing means.

9. The smoke ventilation system of claim 1, wherein:

said mount is a pivotal mount mounting said panel at one side of the body member within the ceiling, allowing said panel to be pivoted between the panel's closed, sealing position and the panel's open position.

10. The smoke ventilation system of claim 1, wherein said panel has weight, and wherein:

said mount includes a support arm connected to said panel through at least one fusible fire link which melts under the heat of a fire, allowing the panel to close under its own weight under the force of gravity when said fusible link is melted.

11. A smoke control ventilation method for use in a building having at least one room with a ceiling dividing the room into an upper air space above the ceiling and a lower air space below the ceiling, said upper air space above the ceiling being used as a return air plenum and said lower air space being used as an environmental zone containing air, comprising the following steps:

(a) using in the ceiling of the building a combined air flow control and smoke ventilation system, including at least one, combined air flow control and smoke ventilation device placed within the ceiling and having at least one panel mounted on a body member, which panel is moveable by a motor between open and closed dispositions with respect to said body member, which, when in the open disposition, allows air in the lower air space to flow through the body member to the upper air space to the air plenum, with the lower and upper air spaces in free communication with each other, and, when in the closed disposition, prevents the air in the lower air space from flowing through the body member to the upper air space to the air plenum, smoke sensing means located in the environmental zone for detecting a predetermined level of smoke within the lower air space, and driven exhaust means associated with said body member including an exhaust duct located within the upper air space for segregating and exhausting the smoke through the smoke ventilation device in a confined manner in the exhaust duct through the upper air space but physically segregated from the air plenum;

(b) actuating said motor to close the panel to its closed disposition, when said smoke sensing means detect the predetermined level of smoke; and (c) actuating said driven exhaust means, when said smoke sensing means detect the predetermined level of smoke, to exhaust smoke from the lower air space at said device in a confined manner in and through the exhaust duct through the upper air space with the smoke physically segregated from the air plenum.

12. The smoke control ventilation method of claim 11, wherein there is included the further steps of:

providing an audible alarm in association with said system and activating said alarm when said smoke sensing means detect the predetermined level of smoke.

13. The smoke control ventilation method of claim 11, wherein there are further included the steps of:

using a pivotal mounting of the panel on the body member at one side of the body member, and pivoting said panel up and down in going from said panel's open and closed dispositions.

14. The smoke control ventilation method of claim 11 wherein said panel has weight, and wherein there are further included the steps of:

providing in connection with said pivoting mounting a support arm connected to said panel through at least one fusible fire link which melts under the heat of a fire, and allowing the panel to close under its own weight under the force of gravity when said at least one fusible fire link is melted.

15. A smoke control ventilation method for use in a building having at least one room with a ceiling dividing the room into an upper air space above the ceiling and a lower air space below the ceiling, said upper air space above the ceiling being used as a return air plenum and said lower air space being used as an environmental zone containing air, comprising the following steps:

(a) using in association with the ceiling in the building a combined air flow control and smoke ventilation system, including at least one, combined air flow control and smoke ventilation device placed within the ceiling and having at least one movable unit mounted on a body member, which movable unit is moveable by a motor between open and closed dispositions with respect to said body member, which, when in the open disposition, allows air in the lower air space to flow through the body member to the upper air space to the air plenum, with the lower and upper air spaces in free communication with each other, and, when in the closed disposition, prevents the air in the lower air space from flowing through the body member to the upper air space to the air plenum, smoke sensing means located in the environmental zone for detecting a predetermined level of smoke within the lower air space, and driven exhaust means associated with said body member including an exhaust duct located within the upper air space for segregating and exhausting the smoke through the smoke ventilation device in a confined manner in the exhaust duct through the upper air space but physically segregated from the air plenum;

(b) actuating said motor to close the moveable unit to its closed disposition, when said smoke sensing means detect the predetermined level of smoke; and (c) actuating said driven exhaust means, when said smoke sensing means detect the predetermined level of smoke, to exhaust smoke from the lower air space at said device in a confined manner in and through the exhaust duct through the upper air space with the smoke physically segregated from the air plenum.

16. A smoke control ventilation system for use in a building having at least one room with a ceiling dividing the room into an upper air space above the ceiling and a lower air space below the ceiling, said upper air space above the ceiling being used as a return air plenum and said lower air space being used as an environmental zone containing air, with the ventilation system to be used in association with the ceiling, comprising:

at least one, combined air flow control and smoke ventilation device to be used in association with the ceiling and having at least one movable unit mounted on a body member to be placed in the ceiling, which movable unit is moveable by a motor between open and closed dispositions with respect to said body member, which, when in the open disposition, allows air in the lower air space to flow through the body member to the upper air space to the air plenum, with the lower and upper air spaces in free communication with each other, and, when in the closed disposition, prevents the air in the lower air space from flowing through the body member to the upper air space to the air plenum, smoke sensing means located in the environmental zone for detecting a predetermined level of smoke within the lower air space, and driven exhaust means associated with said body member including an exhaust duct located within the upper air space for segregating and exhausting the smoke through the smoke ventilation device in a confined manner in the exhaust duct through the upper air space but physically segregated from the air plenum; the motor being actuatable to close the moveable unit to its closed disposition, when said smoke sensing means detect the predetermined level of smoke; and said driven exhaust means being likewise actuable, when said smoke sensing means detect the predetermined level of smoke, to exhaust smoke from the lower air space at said device in a confined manner in and through the exhaust duct through the upper air space with the smoke being physically segregated from the air plenum.

17. The smoke control ventilation system of claim 16, wherein:

said exhaust duct has an entry end extending into said body member below said movable unit with its exit end to be located above the ceiling.

18. The smoke control ventilation system of claim 16, wherein:

said movable unit includes at least one panel pivotally mounted at one side to said body member, allowing said panel to be pivoted between the panel's closed disposition and the panel's open disposition.

* * * * *